US008474539B2

(12) United States Patent
Luo et al.

(10) Patent No.: US 8,474,539 B2
(45) Date of Patent: Jul. 2, 2013

(54) PULL TUBE SLEEVE STRESS JOINT FOR FLOATING OFFSHORE STRUCTURE

(75) Inventors: Michael Y. H. Luo, Bellaire, TX (US); Bob Lixin Zhang, Sugar Land, TX (US); Shih-Hsiao Mark Chang, Houston, TX (US)

(73) Assignee: Technip France, Courbevoie (FR)

( * ) Notice: Subject to any disclaimer, the term of this patent is extended or adjusted under 35 U.S.C. 154(b) by 567 days.

(21) Appl. No.: 12/546,794

(22) Filed: Aug. 25, 2009

(65) Prior Publication Data

US 2011/0048729 A1 Mar. 3, 2011

(51) Int. Cl.
*E21B 17/01* (2006.01)

(52) U.S. Cl.
USPC ..... 166/367; 166/341; 166/344; 166/345; 166/350; 166/355; 405/224.2

(58) Field of Classification Search
USPC ..... 166/341, 344, 345, 349, 350, 355, 166/359, 367; 405/203, 224.2, 224.3, 223.1, 405/224.4
See application file for complete search history.

(56) References Cited

U.S. PATENT DOCUMENTS 4,516,881 A 5/1985 Beynet et al.
4,741,647 A * 5/1988 Dumazy et al. ..... 405/224.4
6,739,804 B1 5/2004 Haun
2003/0021634 A1 1/2003 Munk et al.
2007/0056741 A1* 3/2007 Finn et al. ..... 166/367

FOREIGN PATENT DOCUMENTS

EP 0898047 2/1999
GB 2356229 5/2001

OTHER PUBLICATIONS

Manolache, I., International Search Report for International Patent Application No. PCT/US2010/046296, European Patent Office, dated Apr. 14, 2011.
Manolache, I., Written Opinion for International Patent Application No. PCT/US2010/046296, European Patent Office, dated Apr. 14, 2011.

* cited by examiner

*Primary Examiner* — Matthew Buck
*Assistant Examiner* — James Sayre
(74) *Attorney, Agent, or Firm* — Locke Lord LLP

(57) ABSTRACT

The present disclosure provides an improved design for a pull tube sleeved stress joint and associated pull tube for managing stresses on a catenary riser for a floating offshore structure. The pull tube sleeve stress joint includes at least one sleeve surrounding a length of the pull tube with an annular gap between the sleeve and pull tube and a link ring therebetween. For embodiments having a plurality of sleeves, a first sleeve can be spaced by an annular first gap from the pull tube and coupled thereto with a first ring between the pull tube and the first sleeve, and a second sleeve can be spaced by an annular second gap from the first sleeve and coupled thereto with a second ring between the first sleeve and the second sleeve. Both pull tube and sleeves can be made with regular pipe segments welded together with regular girth welds.

19 Claims, 7 Drawing Sheets

PULL TUBE SLEEVE STRESS JOINT FOR FLOATING OFFSHORE STRUCTURE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure generally relates to the production of hydrocarbons from subsea formations. More particularly, the disclosure relates to the risers and related support structures used in such production.

2. Description of the Related Art

In producing hydrocarbons from subsea formations, a number of wells are typically drilled into the sea floor in positions that are not directly below or substantially within the outline of a floating offshore structure, such as a floating offshore production platform. The produced hydrocarbons are subsequently exported via subsea pipelines or other means. Current engineering practice links the offset wells with the offshore structure through risers that have a catenary curve between the structure and the sea floor. Wave motion, water currents, and wind cause movement of the floating offshore structure and/or risers themselves with corresponding flex and stress in the risers. The current state of the art has accommodated the flex in the risers by incorporating flexible joints at suitable locations between pipe segments in the riser. However, the flexible joints are more expensive and less reliable than pipe segments that are welded together.

Steel Catenary Risers (SCRs) are designed to be coupled to the floating offshore structure through pull tubes extending from the lower keel of the offshore structure to the upper part of the offshore structure. A pull tube is generally a long conduit that forms a guide through which the SCR is pulled from the seafloor and coupled to the offshore structure. The pull tube is attached to the offshore structure at an angle from the vertical so as to be in line with a natural angle that the installed SCR would assume on a calm day. As the offshore structure shifts laterally and vertically, the pull tube helps reduce stresses on the SCR. However, the pull tube itself is then stressed and can fail with time. The pull tube is attached to the offshore structure at different points along the length of the pull tube and thus flexes about its attachment points to the offshore structure as the SCR flexes and bends from the movement of the floating offshore structure. A first attachment point can be located a distance from the lower end of the pull tube. A second attachment point for the pull tube to the offshore structure can be at a distance further upward from the first attachment point to allow additional flexibility in the pull tube. Further, the pull tube can be provided with a bending stiffness that varies from the first attachment point to the lower end of the pull tube. Typically, a tapered stress joint is placed along the pull tube adjacent one of the attachment points and is sized to control the SCR stress.

There are two types of stress joints that have been used in the past. The first one is an assembly of pipe segments welded together. The pipe segments typically have a progressively smaller wall thickness for each segment of a given inside diameter that results in a tapered assembly of the segments with the thinnest segment distal from the middle of the welded assembly to allow more flexibility at the end of the assembly for the SCR. Such assemblies typically are challenged by fatigue performance at the welds between the segments for the many years in which the SCR will likely be used. The second type of stress joint is a forged tapered stress joint. The forging accomplishes a similar goal as the first type by progressively thinning the wall thickness toward the end of the forging typically in the length of 40 ft. However, due to the desired length of a pull tube stress joint, additional pull tube segments are typically welded to the forging. Thus, the challenge is still fatigue performance at the welds between the segments and forging. Another challenge can be cost and manufacturing schedules specific to a lengthy forging piece.

More particularly, FIG. 1 is an exemplary prior art schematic of a pull tube stress joint. The pull tube stress joint 50 is adapted to allow a riser 53 to be pulled therethrough and includes a tapered middle section 51, which can be one of the two types described above of a progressively smaller wall thickness of an assembly of pipe segments or a continuous forging. The middle section 51 has a length "L", which can for example be about 40 feet (12 meters) and is typically centrally disposed relative to a pivot point "A", so that a ½ L length extends 20 feet (6 meters) outward therefrom in this example. A pull tube joint 52 is welded to the end of the middle section 51 at welding B about 20 feet (6 meters) from the pivot point A. The stresses at welding B are such that special and expensive welding procedures known as a "C Class Girth Weld" are typically specified to attempt to reduce fatigue at the welding B at the 20 foot (6 meter) location from the pivot point A. While a longer middle section could be used to extend the ½ L length from the pivot point A, the expense and timing of production and handling make such an option unsuitable for practical reasons.

There remains then a need for an improved design of a suitably long lasting, cost effective pull tube stress joint for catenary risers.

BRIEF SUMMARY OF THE INVENTION

The present disclosure provides an improved design for a pull tube sleeved stress joint and associated pull tube for managing stresses on a catenary riser for a floating offshore structure. The new design efficiently results in a pull tube sleeved stress joint with at least one sleeve coupled to a pull tube having an annular gap between the outside periphery of the pull tube and the inside periphery of the sleeve with at least one connecting link ring disposed therebetween. For embodiments having a plurality of sleeves, a first sleeve can be spaced by an annular first gap from the pull tube and coupled thereto with a first link ring between the pull tube and the first sleeve, and a second sleeve can be spaced by an annular second gap from the first sleeve and coupled thereto with a second link ring between the first sleeve and the second sleeve. Welded connections between pull tube joints can be longitudinally spaced distally from the sleeve coupled to the pull tube to minimize stresses on the welded connection. Further, a sleeve guide coupled to the offshore structure, and adapted to couple the pull tube and assembly to the offshore structure, can be longitudinally offset by a distance from the link ring and its connections between the pull tube and the sleeve. The design increases a section modulus of the pull tube sleeved stress joint compared to prior efforts at the region of the sleeve guide by placing at least one sleeve on the pull tube and placing a girth weld to adjacent pull tube joints at a zone of lower stress than prior efforts. Thus, the girth welds can be made with a regular weld procedure known as a "F2 Class Weld" instead of the more complex and expensive, and heretofore specified "C Class Girth Weld". The design can be adjusted to different performance criteria by changing girth weld locations, length of the sleeve, outside and inside diameters of the sleeve, number of sleeves, spacers between the sleeve and pull tube and between multiple sleeves if any, and other changes. Such changes can be performed at the fabrication yard for the offshore structure and independent of forgings and prefabrication efforts at specialized locations.

The disclosure provides a system for supporting a catenary riser coupled to an offshore structure, comprising: a pull tube having one end disposed downward from the offshore structure and a portion coupled to the offshore structure, the pull tube having one or more segments; a stress joint middle segment having an outer diameter and an inner diameter defining a passageway for the catenary riser therein, the stress joint middle segment being coupled to one or more segments of the pull tube; a first sleeve disposed around a length of the stress joint middle segment, the first sleeve having an outer diameter and an inner diameter, the sleeve inner diameter and the stress joint middle segment outer diameter defining a first annular gap therebetween; and a sleeve guide coupled to the offshore structure and at least partially surrounding a periphery of the first sleeve.

The disclosure also provides a pull tube sleeved stress joint assembly for a pull tube on a floating offshore structure, the pull tube having one end disposed downward from the offshore structure and having an outer diameter and an inner diameter defining a passageway for a catenary riser therein, the pull tube sleeved stress joint assembly comprising: a sleeve disposed around a length of the pull tube, the sleeve having an outer diameter and an inner diameter, the sleeve inner diameter and the pull tube outer diameter defining an annular gap therebetween, the sleeve being coupled with the offshore structure.

The disclosure further provides a pull tube sleeved stress joint assembly for a pull tube on a floating offshore structure, comprising: a stress joint middle segment having an outer diameter and an inner diameter defining a passageway for a catenary riser therein, the stress joint middle segment coupled to one or more segments of the pull tube, the pull tube having one end disposed downward from the offshore structure; and a first sleeve disposed around a length of the stress joint middle segment, the first sleeve having an outer diameter and an inner diameter, the sleeve inner diameter and the stress joint middle segment outer diameter defining a first annular gap therebetween.

DETAILED DESCRIPTION

Figure 1:
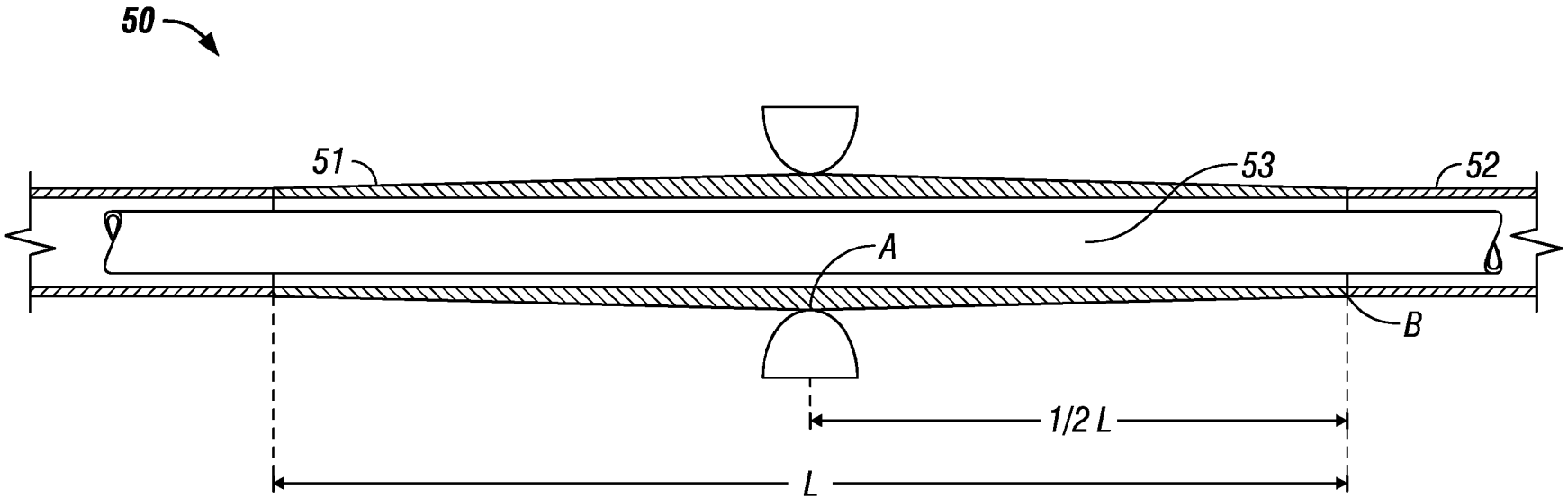
FIG. 1 (Prior Art)
FIG. 1 is an exemplary prior art schematic of a pull tube stress joint.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an "a" or "b" to designate one side of the system or another. When referring generally to such elements, the number without the letter is used. Further, such designations do not limit the number of elements that can be used for that function.

In general, the present disclosure provides an improved design for a pull tube sleeve stress joint and associated pull tube for managing stresses on a catenary riser for a floating offshore structure. The new design efficiently results in a pull tube sleeve stress joint with at least one sleeve coupled to a pull tube having an annular gap between the outside periphery of the pull tube and the inside periphery of the sleeve with at least one connecting spacer disposed therebetween. For embodiments having a plurality of sleeves, a first sleeve can be spaced by an annular first gap from the pull tube and coupled thereto with a first link ring between the pull tube and the first sleeve, and a second sleeve can be spaced by an annular second gap from the first sleeve and coupled thereto with a second link ring between the first sleeve and the second sleeve. Welded connections between pull tube joints can be longitudinally spaced distally from the sleeve coupled to the pull tube to minimize stresses on the welded connection. Further, a sleeve guide coupled to the offshore structure, and adapted to couple the pull tube and assembly to the offshore structure, can be longitudinally offset by a distance from the link ring and its connections between the pull tube and the sleeve. The design increases a section modulus of the pull tube stress joint compared to prior efforts at the region of the sleeve guide by placing at least one sleeve on the pull tube and placing a girth weld to adjacent pull tube joints at a zone of lower stress than prior efforts. The design can be adjusted to different performance criteria by changing girth weld locations, length of the sleeve, outside and inside diameters of the sleeve, number of sleeves, spacers between the sleeve and pull tube and between multiple sleeves if any, and other changes. Such changes can be performed at the fabrication yard for the offshore structure and independent of forgings and prefabrication efforts at specialized locations.

Figure 2:
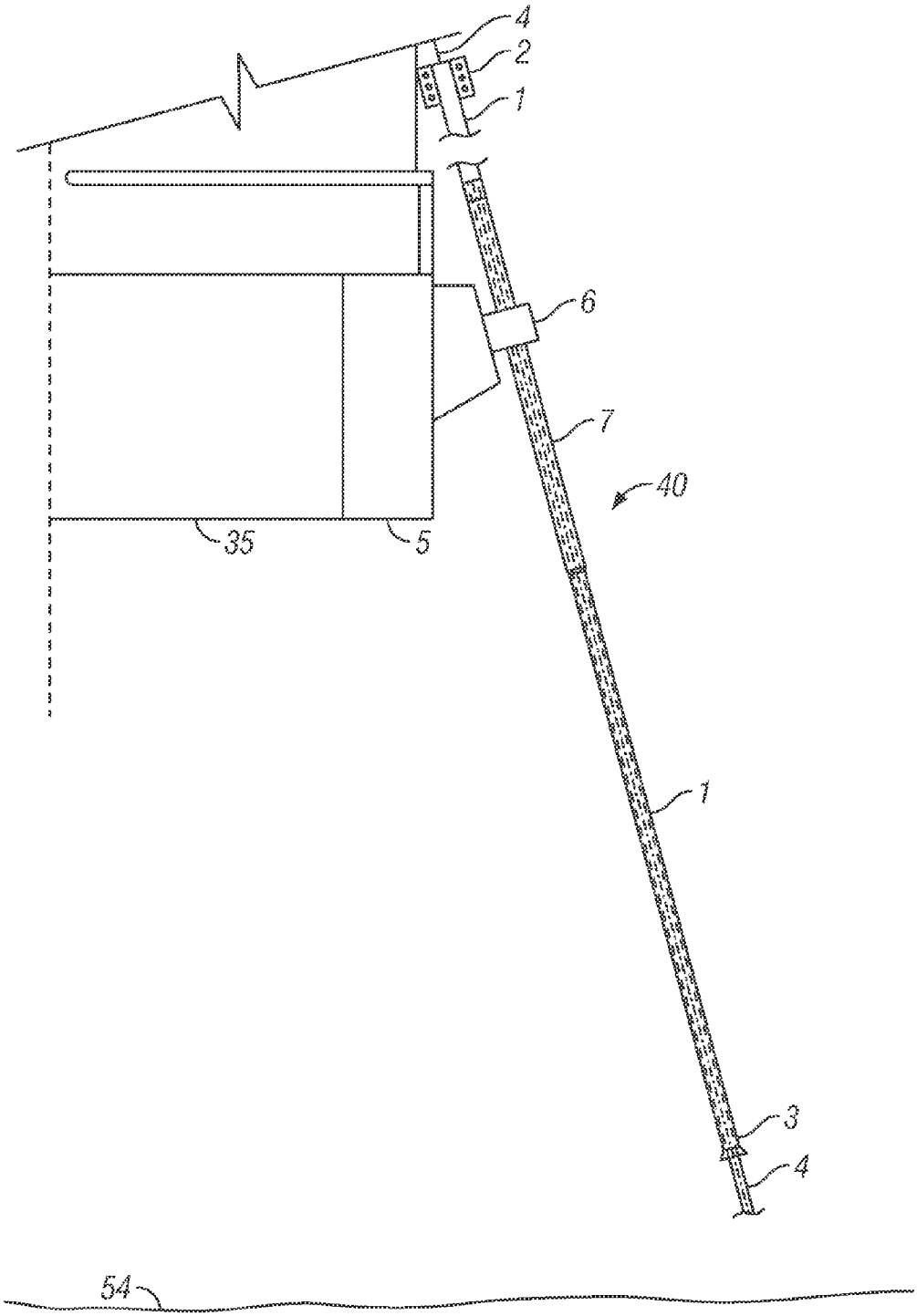
FIG. 2 is a side view schematic diagram illustrating an exemplary embodiment of a pull tube sleeved stress joint assembly installed on a floating offshore structure, such as a Spar.

FIG. 2 is a side view schematic diagram illustrating an exemplary embodiment of a pull tube sleeved stress joint assembly installed on a floating offshore structure, such as a Spar. The pull tube 1 is coupled to the offshore structure 35, such as at an upper support 2. The bottom 3 of the pull tube 1 is generally directed downward from the offshore structure 35 toward a seafloor 54 and the end is flared open to insert and guide a Steel Catenary Riser 4 (SCR) from a seafloor into the pull tube 1. The pull tube 1 is maintained in proximity to the offshore structure 35, such as in proximity to a soft tank 5, by a sleeve guide 6, also referenced as a "casting guide". The casting guide 6 extends laterally outward from the offshore structure 35 to provide a transition of angle of the catenary shape of the SCR 4, as the SCR approaches the coupling with the offshore structure 35. The pull tube sleeved stress joint assembly 40 generally includes at least one sleeve 7 that surrounds a length of the pull tube 1 inside the casting guide 6, where the sleeve 7 is maintained in position by a link ring (described below) relative to the pull tube 1 to form an annular gap between the pull tube 1 and the sleeve 7. In at least one embodiment, the pull tube sleeved stress joint assembly 40 can include a segment of the pull tube 1 that is welded or otherwise coupled to the sleeve 7 and the link ring to form the assembly.

Figure 3:
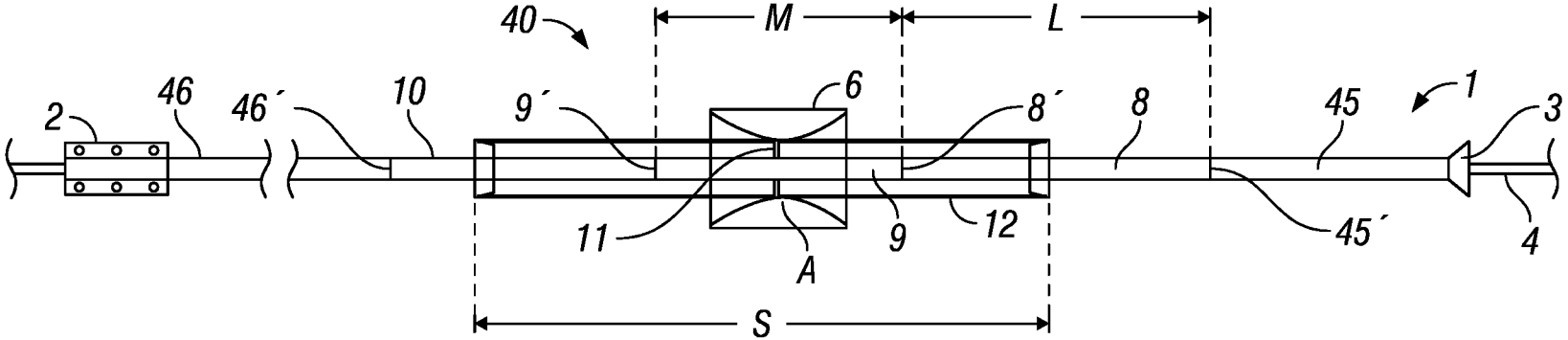
FIG. 3 is a side view schematic diagram illustrating an exemplary embodiment of the pull tube sleeved stress joint assembly with one sleeve.
Figure 3A:
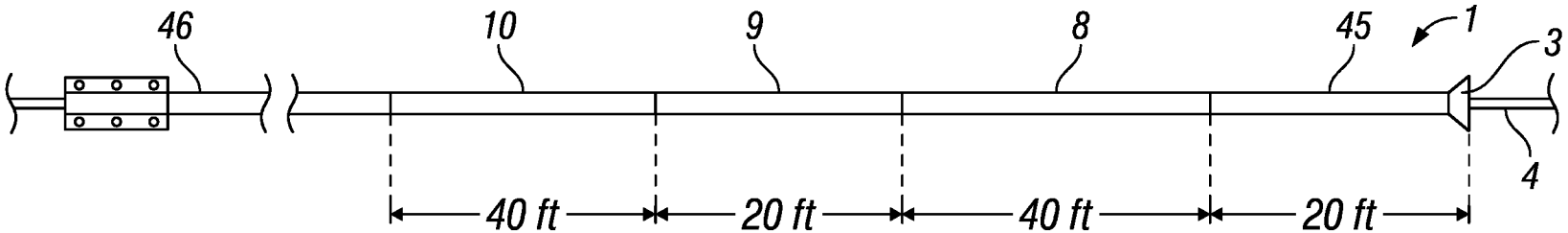
FIG. 3A is a side view schematic diagram illustrating the pull tube without the sleeve of FIG. 3.

FIG. 3 is a side view schematic diagram illustrating an exemplary embodiment of the pull tube sleeved stress joint assembly with one sleeve. FIG. 3A is a side view schematic diagram illustrating the pull tube without the sleeve of FIG. 3. The figures will be described in conjunction with each other. The pull tube 1 can include a plurality of segments, such as a pull tube bottom segment 8, a stress joint middle segment 9, and a pull tube top segment 10. Other pull tube segments 45, 46 can be coupled to the pull tube segments 8, 10 such as by weldings 45', 46', respectively, to extend the length of the pull tube 1. The bottom segment 8 is disposed toward the bottom 3 of the pull tube 1. The bottom segment 8 can be welded to the middle segment 9 by a groove welding 8'. The upper and opposite end of the middle segment 9 can be welded to the top segment 10 by another groove welding 9'. The upper end of the pull tube 1 can be coupled to the offshore structure, such as at the upper support 2. A sleeve 12 surrounds a length of the middle segment 9 and forms the pull tube sleeved stress joint assembly 40. A link ring 11 can be welded between the middle segment 9 and the sleeve 12 to maintain an annular gap therebetween at the link ring location. The pull tube sleeved stress joint assembly 40 is maintained relative to the offshore structure 2 by a relatively stationary guide 6 disposed adjacent the sleeve 12 and the middle segment 9 inside the sleeve.

In at least one embodiment, the sleeve 12 has a length "S" that is longer than a length "M" of the middle segment 9. Thus, the ends of the sleeve 12 extend beyond the ends of the middle segment 9 and the groove weldings 8', 9' for the adjacent joints 8, 10, respectively.

The casting guide 6 can act as a pivot point "A" for the sleeve 12 surrounding the stress joint middle segment 9, as the pull tube 1 bends in a catenary manner. However, the sleeve 12 can diffuse the stress on the stress joint middle segment 9 as the middle segment bends from the stress. For example, when the middle segment bends sufficiently to touch the inside wall on the middle segment distal from link ring 11, the middle segment can restrict bending and therefore stress on the pull tube. Further, the location of the weldings can be changed, so that less stress from the pull tube bending is applied to the weldings. The middle segment, having length "M" with a guide 6 approximately halfway along length "M", results in a welding 8' spaced by about ½ M from the pivot point A (with a corresponding length ½ M for welding 9').

While this ½ M length to welding 8' can be actually less in distance from the pivot point A than the ½ L length to welding B shown in FIG. 1, the stress on the welding 8' is restricted by the sleeve 12. Still further, the next welding 45', which may be beyond the sleeve 12, is spaced ½ M length plus an additional length L, resulting in the welding 45' being farther from the pivot point A at a reduced stress than the welding B at length ½ L in FIG. 1. In short, the location of welding B in FIG. 1 can be avoided in the inventive design shown in FIG. 3.

For an exemplary 40 feet (12 meter) pull tube joint of length L, the ½ L position of 20 feet (6 meters) for welding B is shown in FIG. 1. By contrast, if the middle segment 9, shown in FIG. 3, has a length M of about 20 feet (6 meters), then welding 8' at ½ M position is about 10 feet (6 meters) from the pivot point A. The sleeve 12 with a length S can overlap the ends of the middle portion of the length M and/or restrict the stress on the pull tube 1 at the welding 8'. Further, for a standard length L of 40 feet (12 meters) for the pull tube joint 8, the welding 45' between the pull tube joints 8, 45 is positioned an additional 40 feet (12 meters) from the pivot point A. Thus, the welding 45' is positioned a total distance of about 50 feet (15 meters) from the pivot point A. Since the welding 45' is located in a lower stress level position compared the position of the welding B at about 20 feet (6 meters) from the pivot point A, the fatigue life of welding 45' can be controlled. The new design allows a more efficient, less costly, site-fabricated pull tube stress joint to be created and used with more standard and less expensive components and welding processes.

Figure 4:
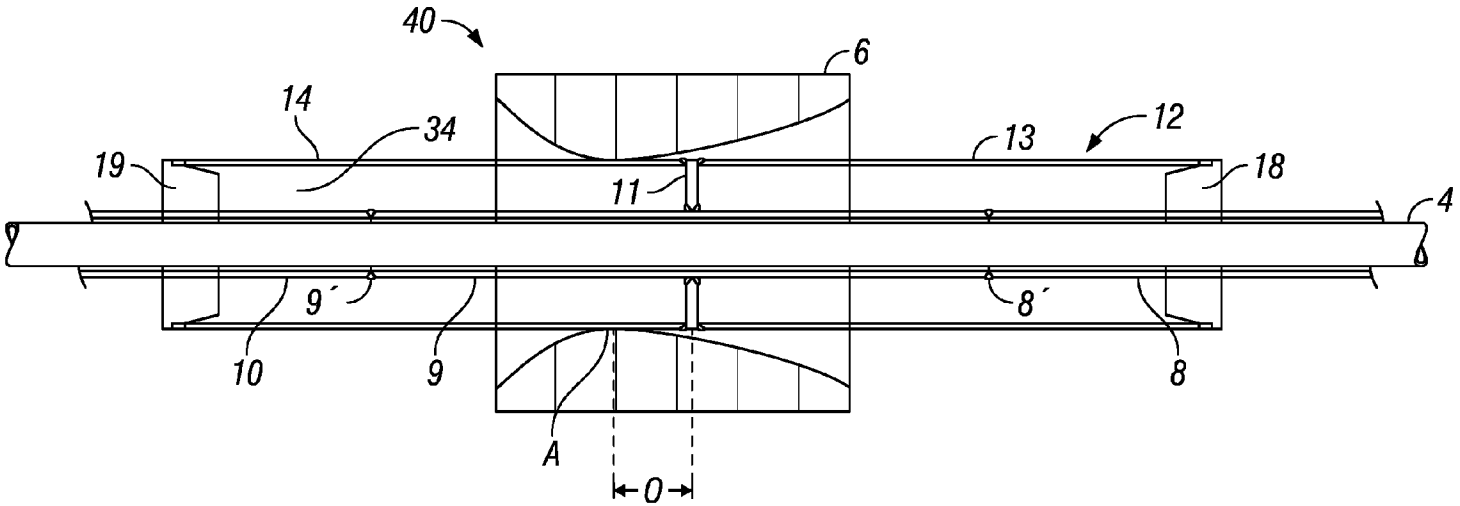
FIG. 4 is a detail side view schematic diagram illustrating the exemplary embodiment of the pull tube sleeved stress joint assembly with one sleeve of FIG. 3.
Figure 5:
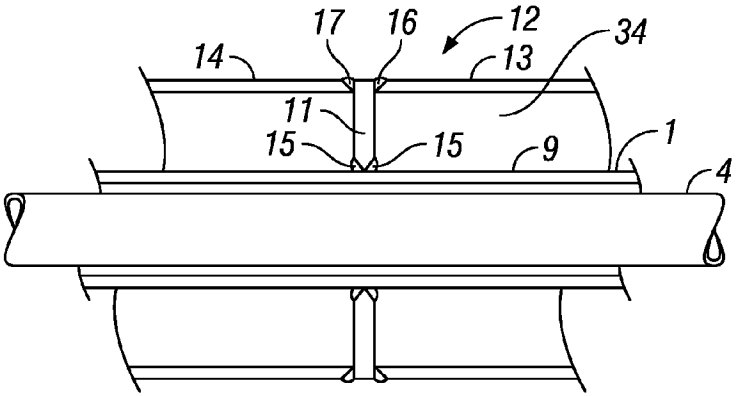
FIG. 5 is a detail side view schematic diagram illustrating the welding between a pull tube joint, a link ring, and the sleeve of FIG. 3.

FIG. 4 is a detail side view schematic diagram illustrating the exemplary embodiment of the pull tube sleeved stress joint assembly with one sleeve of FIG. 3. FIG. 5 is a detail side view schematic diagram illustrating the welding between a pull tube joint, a link ring, and the sleeve of FIG. 3. The figures will be described in conjunction with each other. A link ring 11 can be welded on an outer surface of the middle segment 9 at welding 15. An inner diameter of the link ring 11 can be the same as the outer diameter of the middle segment 9 (subject to clearances for an installation over the outer diameter and so forth for the interface, as well as for other interfaces herein). A first segment 13 of the sleeve 12 can be welded to the link ring 11 by a welding 16. A second segment 14 of the sleeve 12 can be welded to the link ring 11 by a welding 17 distal from the first segment 13 relative to the link ring 11. The outer diameter of the link ring 11 can be the same as the outer diameter of the segments 13 and 14 of the sleeve 12. The outer periphery, such as an outer diameter, of the middle segment 9, and the inner periphery, such as an inner diameter, of the sleeve 12 define an annular gap 34 between the middle segment 9 and the sleeve 12. The link ring 11 can be coupled to the middle segment 9 at a longitudinal offset "O" from the pivot point A of the guide 6. Further, the guide 6 can have an elliptical or other shaped inside contour, such as shown in FIG. 4.

A spacer 18, such as a split shim, can be inserted in the segment 13 of the sleeve 12 and welded to segment 13 or otherwise coupled thereto. Another spacer 19, such as a split shim, can be inserted in the segment 14 of the sleeve 12 and coupled to segment 14. The split shims are illustrative of spacers that can maintain the annular gap 34 between the pull tube segments and the sleeve 12 at the ends of the sleeve 12. Other types and quantities of spacers can be used. The spacers can change the stress level on the pull tube by causing a different inflection point for bending of the pull tube section at the spacers. The spacers can be avoided if desired.

Figure 6:
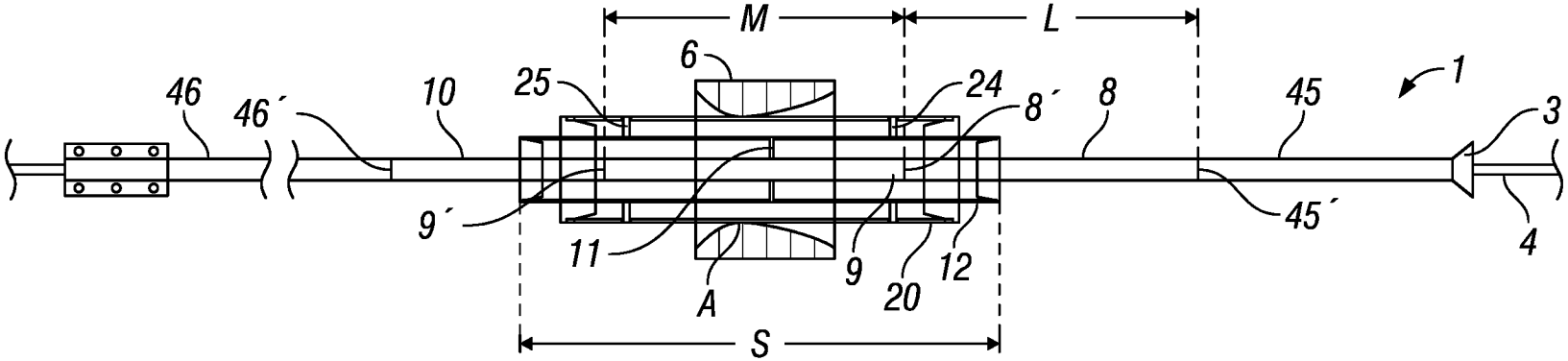
FIG. 6 is a side view schematic diagram illustrating another exemplary embodiment of a pull tube sleeved stress joint assembly with a plurality of sleeves.
Figure 6A:
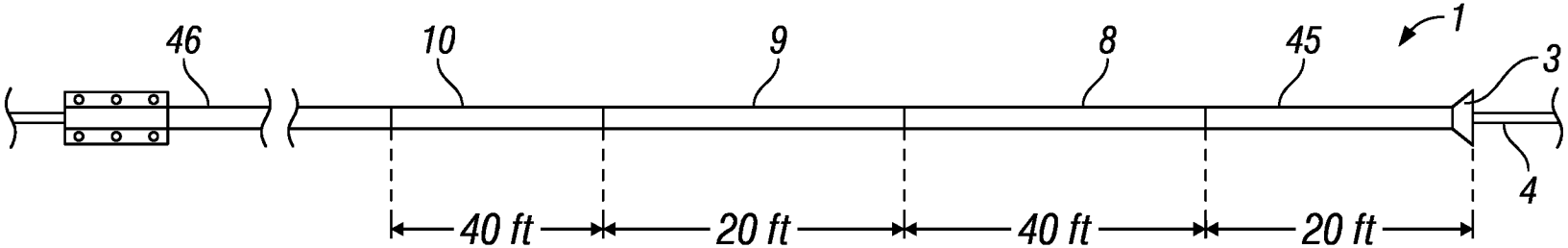
FIG. 6A is a side view schematic diagram illustrating the pull tube without the sleeve of FIG. 6.

FIG. 6 is a side view schematic diagram illustrating another exemplary embodiment of a pull tube sleeved stress joint assembly with a plurality of sleeves. FIG. 6A is a side view schematic diagram illustrating the pull tube without the sleeve of FIG. 6. The figures will be described in conjunction with each other. The pull tube 1 can include a plurality of segments, such as a pull tube bottom segment 8, a stress joint middle segment 9, and a pull tube top segment 10. Other pull tube segments 45, 46 can be coupled to the pull tube segments 8, 10 such as by weldings 45', 46', respectively to extend the length of the pull tube. The bottom segment 8 is disposed toward the bottom 3 of the pull tube 1. The bottom segment 8 can be welded to the middle segment 9 by a groove welding 8'. The upper and opposite end of the middle segment 9 can be welded to the top segment 10 by another groove welding 9'. The upper end of the pull tube 1 can be coupled to the offshore structure, such as at the upper support 2. A first sleeve 12 surrounds a length of the middle segment 9 of the pull tube 1 and a second sleeve 20 surrounds a length of the first sleeve 12. A link ring 11 can be welded between the middle segment 9 and the sleeve 12 to maintain an annular gap therebetween at the location of the link ring 11. Link rings 24, 25 can be welded between the sleeve 12 and the sleeve 20 to maintain an annular gap therebetween at the locations of link rings 24, 25. The pull tube sleeved stress joint assembly 40 is maintained relative to the offshore structure 2 by a guide 6 disposed adjacent the sleeve 20.

Figure 7:
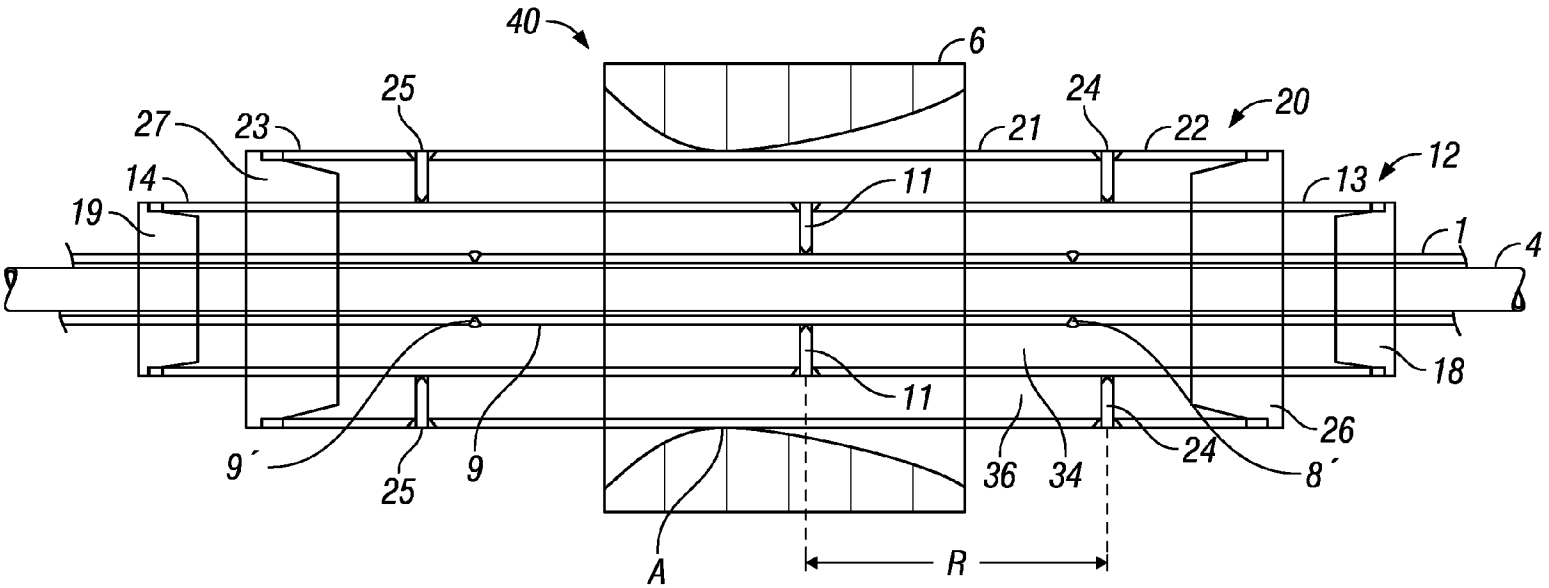
FIG. 7 is a detail side view schematic diagram illustrating the exemplary embodiment of a pull tube sleeved stress joint assembly with the plurality of sleeves of FIG. 6.

FIG. 7 is a detail side view schematic diagram illustrating the exemplary embodiment of a pull tube sleeved stress joint assembly with the plurality of sleeves of FIG. 6. A link ring 11 can be welded on the outer surface of the middle segment 9. The inner diameter of the link ring 11 can be the same as the outer diameter of the middle segment 9 of the pull tube 1. A first segment 13 of the sleeve 12 can be welded to the link ring 11. A second segment 14 can be welded to the link ring 11, opposite from the location of the first segment 13 relative to the link ring 11. The outer diameter of the link ring 11 can be the same as the outer diameter of the segments 13 and 14 of the sleeve 12. The outer periphery, such as an outer diameter, of the middle segment 9, and the inner periphery, such as an inner diameter, of the sleeve 12 define an annular gap 34 between the middle segment 9 and the sleeve 12. A spacer 18 can be inserted in the segment 13 of the sleeve 12, and welded to segment 13. Another spacer 19 can be inserted in the segment 14 of the sleeve 12, and welded to the segment 14.

A first link ring 24 for the second sleeve 20 can be welded on the outer surface of the segment 13 of the first sleeve 12. The first link ring 24 of the second sleeve 20 is generally longitudinally offset from the link ring 11 by an offset "R". A first segment 21 of the sleeve 20 can be welded to the link ring 24. A second link ring 25 can be welded on the outer surface of the segment 14 of the first sleeve 12 on an opposite end of the first segment 21 relative to the first link ring 24. The second link ring 25 can also be welded to the first segment 21. A second segment 22 of the second sleeve 20 can be welded to the link ring 24 on an opposite side of the link ring 24 relative to the first segment 21. A third segment 23 of the sleeve 20 can be welded to the link ring 25 on an opposite side of the link ring 25 relative to the first segment 21. The inner diameter of the link rings 24 and 25 can be the same as the outer diameter of the segments 13 and 14 of the sleeve 12. The outer diameter of the link rings 24 and 25 can be the same as the outer diameter of the segments 21, 22, and 23 of the sleeve 20. The outer periphery, such as an outer diameter, of the sleeve 12 and the inner periphery, such as an inner diameter, of the sleeve 20 define an annular gap 36 between the sleeve 12 and the sleeve 20. A spacer 26 can be inserted in the segment 22 of the sleeve 20, and welded to segment 22. Another spacer 27 can be inserted in the segment 23 of the sleeve 20, and welded to segment 23.

Figure 8:
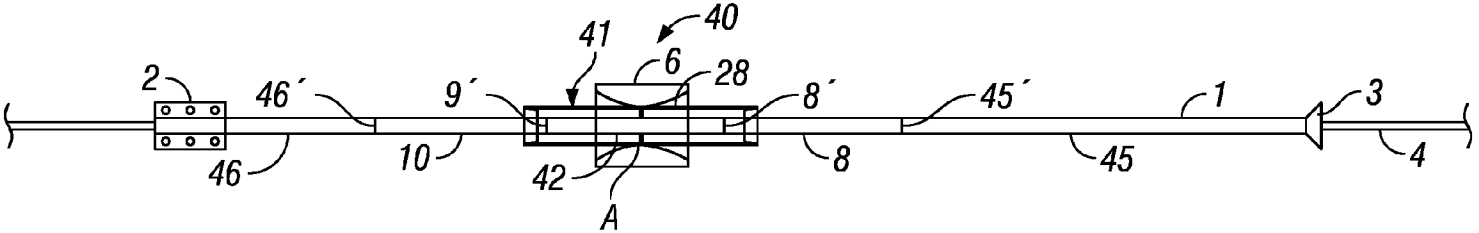
FIG. 8 is a side view schematic diagram illustrating another exemplary embodiment of a pull tube sleeved stress joint assembly with a forging link.

FIG. 8 is a side view schematic diagram illustrating another exemplary embodiment of a pull tube sleeved stress joint assembly with a forging link. The pull tube 1 can include a plurality of segments, such as a pull tube bottom segment 8 and a pull tube top segment 10, both segments cooperating with an inner middle segment 42 of the forging link 28 to form a pull tube through passage for the riser 4. Other pull tube segments 45, 46 can be coupled to the pull tube segments 8, 10 such as by weldings 45', 46', respectively to extend the length of the pull tube. The bottom segment 8 is disposed toward the bottom of the pull tube. The bottom segment 8 can be welded to the inner middle segment 42 by a groove welding 8'. The upper and opposite end of the inner middle segment 42 can be welded to the top segment 10 by another groove welding 9'. The upper end of the pull tube 1 can be coupled to the offshore structure, such as at the upper support 2. A sleeve 41 can surround a length of the inner middle segment 42 and incorporate a sleeve segment of the forging link 28 described below. The pull tube sleeved stress joint assembly 40 is maintained relative to the offshore structure 2 by a guide 6 disposed adjacent the sleeve 28.

Figure 9:
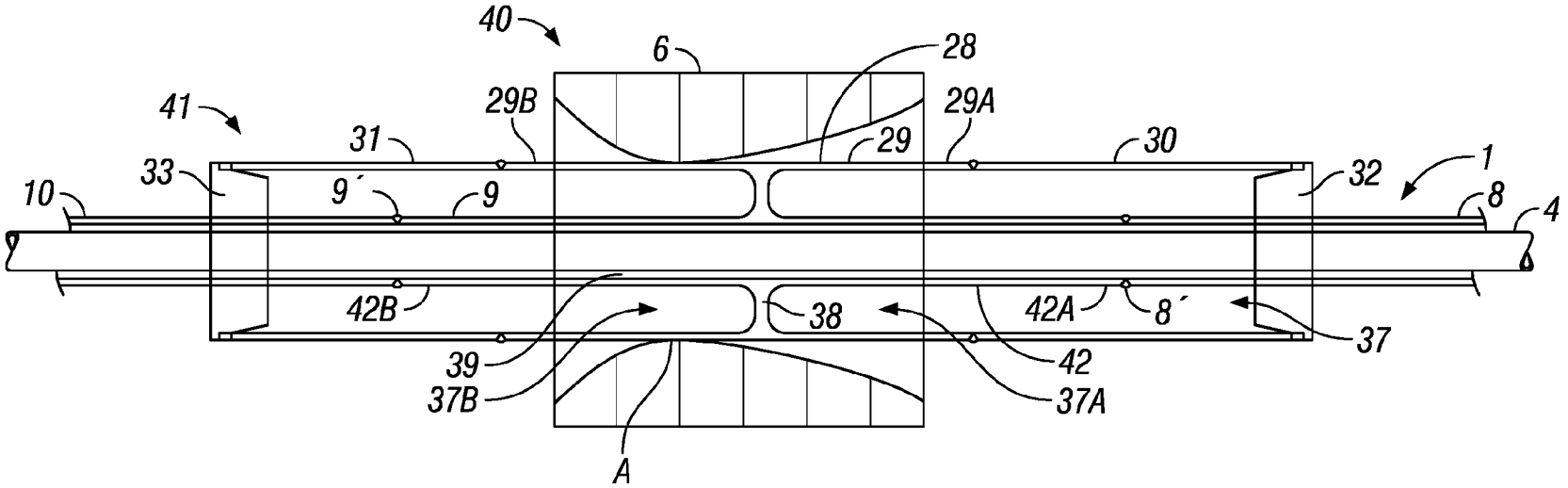
FIG. 9 is a detail side view schematic diagram illustrating the exemplary embodiment of a pull tube sleeved stress joint assembly with the forging link of FIG. 8.
Figure 10:
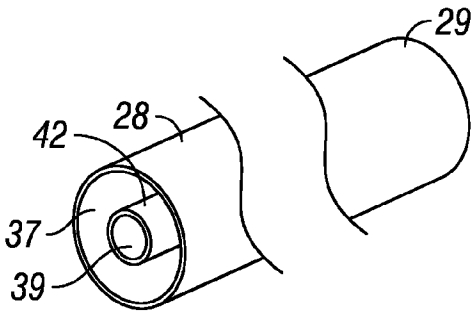
FIG. 10 is a perspective end view of the forging link in FIG. 9.

FIG. 9 is a detail side view schematic diagram illustrating the exemplary embodiment of a pull tube sleeved stress joint assembly with the forging link of FIG. 8. FIG. 10 is a perspective end view of the forging link in FIG. 9. The figures will be described in conjunction with each other. In this embodiment, the pull tube sleeved stress joint assembly 40 includes a forging link 28 that provides characteristics of a sleeve combined with characteristics of a stress joint middle segment, both described above in the preceeding figures. The forging link 28 includes an outer first segment 29 and an inner middle segment 42. The inner middle segment 42 includes a longitudinal passageway 39 bounded by a peripheral wall. The inner middle segment 42 is sized to be coupled, such as welded, with pull tube components on each end of the middle segment 42. Specifically, the middle segment 42 can be welded at welding 8' with a pull tube bottom segment 8 on a first end 42A of the middle segment 42. The middle segment 42 can be welded at welding 9' with a pull tube top segment 10 on a second end 42B of the middle segment 29.

The outer first segment 29 surrounds at least a portion of the inner middle segment 42 and defines an annular gap 37 therebetween. A link ring 38 formed between the first segment 29 and the inner middle segment 42 can assist in maintaining the gap 37. Generally, with the forging link 28, the link ring 38 is integrally forged in place and separates the annular gap 37 into two longitudinal annular gap portions 37A, 37B. Further, a second segment 30 can be welded to a first end 29A of the first segment 29. A third segment 31 can be welded to the second end 29B of the first segment 29. One or more of the segments 29, 30, and 31 can form the sleeve 41 surrounding a length of the inner middle segment 42. A spacer 32 can be inserted in the segment 30, and welded thereto. Another spacer 33 can be inserted in the segment 31, and welded thereto.

Other and further embodiments utilizing one or more aspects of the inventions described above can be devised without departing from the spirit of the disclosed invention. For example and without limitation, the pull tubes, sleeves, and components thereof, can be round or other geometric shapes, so that the use of the term "diameter" is to be construed broadly to mean a inside or outside periphery, as the case may be, that may or may not be round. The embodiments have generally been described in terms of welding, because the general state of the art is conducive to welding, but the invention is not limited to welding and can include any suitable form of coupling, such as clamping, grouting, fastening, and other coupling means as further defined below. Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A system for supporting a catenary riser coupled to an offshore structure, comprising:

a pull tube having one end disposed downward from the offshore structure and an upper portion distal from the one end fixedly coupled to the offshore structure at a first location, the pull tube having one or more segments;

a stress joint middle segment having an outer diameter and an inner diameter defining a passageway for the catenary riser therein, the stress joint middle segment being coupled to one or more segments of the pull tube;

a first sleeve disposed around a length of the stress joint middle segment, the first sleeve having an outer diameter and an inner diameter, the sleeve inner diameter and the stress joint middle segment outer diameter defining a first annular gap therebetween; and a sleeve guide coupled to the offshore structure at a second location different from the first location and at least partially surrounding a periphery of the first sleeve, wherein the combination of the pull tube portion fixedly coupled to the offshore structure at the first location and the sleeve guide coupled to the offshore structure at the second location maintains the position of the pull tube relative to the offshore structure at such locations during usage.

2. The system of claim 1, wherein the first sleeve has a length longer than the stress joint middle segment to extend beyond a location at which the stress joint middle segment is coupled to the one or more pull tube segments.

3. The system of claim 1, wherein the first sleeve is slidably coupled with the offshore structure through the sleeve guide.

4. The system of claim 1, further comprising a second sleeve disposed around a length of the first sleeve, the second sleeve having an outer diameter and an inner diameter, the sleeve inner diameter of the second sleeve and the outer diameter of the first sleeve defining a second annular gap therebetween.

5. The system of claim 1, further comprising a first link ring coupled between the first sleeve and the stress joint middle segment.

6. The system of claim 1, further comprising a second link ring coupled between the second sleeve and the first sleeve.

7. The system of claim 1, further comprising a spacer in proximity to an end of the first sleeve and coupled between the first sleeve and one or more segments of the pull tube.

8. A pull tube sleeved stress joint assembly for a pull tube on a floating offshore structure, the pull tube having one end disposed downward from the offshore structure and an upper portion distal from the one end fixedly coupled to the offshore structure at a first location and having an outer diameter and an inner diameter defining a passageway for a catenary riser therein, the pull tube sleeved stress joint assembly comprising: a sleeve guide coupled to the offshore structure, a sleeve coupled to the pull tube, the sleeve having an outer diameter and an inner diameter, the sleeve inner diameter and the pull tube outer diameter defining an annular gap therebetween, the sleeve being coupled with the offshore structure at a second location different from the first location, wherein the combination of the pull tube portion fixedly coupled to the offshore structure at the first location and the sleeve guide coupled to the offshore structure at the second location maintains the position of the pull tube relative to the offshore structure at such locations during usage.

9. The assembly of claim 8, further comprising a second sleeve disposed around a length of the first sleeve, the second sleeve having an outer diameter and an inner diameter, the sleeve inner diameter of the second sleeve and the outer diameter of the first sleeve defining a second annular gap therebetween.

10. The assembly of claim 8, wherein the pull tube comprises a plurality of pull tube segments coupled together and the sleeve has a length longer than at least one pull tube segment surrounded by the sleeve so that ends of the sleeve extend beyond the coupling on each end of the surrounded pull tube segment with adjacent pull tube segments.

11. A pull tube sleeved stress joint assembly for a pull tube on a floating offshore structure, comprising: a sleeve guide coupled to the offshore structure, a stress joint middle segment having an outer diameter and an inner diameter defining a passageway for a catenary riser therein, the stress joint middle segment rigidly coupled to one or more segments of the pull tube, the pull tube having one end disposed downward from the offshore structure and an upper portion distal from the one end fixedly coupled to the offshore structure at a first location; and a first sleeve coupled to the stress joint middle segment, the first sleeve having an outer diameter and an inner diameter, the sleeve inner diameter and the stress joint middle segment outer diameter defining a first annular gap therebetween, the sleeve being coupled to the offshore structure at a second location different from the first location, wherein the combination of the pull tube portion fixedly coupled to the offshore structure at the first location and the sleeve guide coupled to the offshore structure at the second location maintains the position of the pull tube relative to the offshore structure at such locations during usage.

12. The assembly of claim 11, wherein the first sleeve has a length longer than the stress joint middle segment to extend beyond a location at which the stress joint middle segment is coupled to the one or more pull tube segments.

13. The assembly of claim 11, further comprising a second sleeve disposed around a length of the first sleeve, the second sleeve having an outer diameter and an inner diameter, the sleeve inner diameter of the second sleeve and the outer diameter of the first sleeve defining a second annular gap therebetween.

14. The assembly of claim 11, further comprising the catenary riser, the catenary riser extending from below the floating offshore platform and upward through the pull tube, and being coupled to the offshore structure.

15. The assembly of claim 11, further comprising a link ring coupled between the first sleeve and the stress joint middle segment.

16. The assembly of claim 13, further comprising a link ring coupled between the second sleeve and the first sleeve.

17. The assembly of claim 11, wherein the first sleeve and the stress joint middle segment comprises a forging link.

18. The assembly of claim 11, further comprising a spacer in proximity to an end of the first sleeve and coupled between the first sleeve and one or more segments of the pull tube.

19. The assembly of claim 12, wherein the first sleeve is slidably coupled with the offshore structure.

* * * * *